US005672962A

United States Patent [19]

Sweeney

[11] Patent Number: 5,672,962

[45] Date of Patent: Sep. 30, 1997

[54] FREQUENCY COMPENSATED CURRENT OUTPUT CIRCUIT WITH INCREASED GAIN

[75] Inventor: Frank J. Sweeney, Rowlett, Tex.

[73] Assignee: Texas Instruments Incorporated, Dallas, Tex.

[21] Appl. No.: 755,724

[22] Filed: Nov. 25, 1996

Related U.S. Application Data

[63] Continuation of Ser. No. 349,234, Dec. 5, 1994, abandoned.

[51] Int. Cl.[6] ..... G05F 3/08; G05F 3/20

[52] U.S. Cl. ..... 323/315; 323/312

[58] Field of Search ..... 323/312, 313, 323/314, 315, 316, 317; 330/257, 288

[56] References Cited

U.S. PATENT DOCUMENTS

| | | | |
|---|---|---|---|
| 4,315,223 | 2/1982 | Haque | 330/253 |
| 4,567,537 | 1/1986 | Kalkhof et al. | 361/18 |
| 4,618,816 | 10/1986 | Monticelli | 323/316 |
| 4,890,052 | 12/1989 | Hellums | 323/315 |
| 5,134,358 | 7/1992 | Agiman . | |
| 5,182,526 | 1/1993 | Nelson | 330/257 |
| 5,311,115 | 5/1994 | Archer . | |
| 5,410,241 | 4/1995 | Cecil | 323/315 |

*Primary Examiner*—Peter S. Wong
*Assistant Examiner*—Bao Q. Vu
*Attorney, Agent, or Firm*—Mark E. Courtney; W. James Brady, III; Richard L. Donaldson

[57] ABSTRACT

A frequency compensated current output circuit with increased gain. The current output circuit is an improved current mirror where the gate of an output transistor (MP06) is coupled to an impedance (Ra) located in the conductive path of the mirror transistor (MP05), so that the current flowing out of the circuit is increased by an amount proportional to the resistive value of the impedance (Ra). The circuit includes a frequency compensation network (Rc, Cc) to offset the gain peaking effects which occur in the frequency response of the circuit due to the gain impedance. An output amplifier is described using the current output circuit. Other embodiments are described.

8 Claims, 3 Drawing Sheets

FREQUENCY COMPENSATED CURRENT OUTPUT CIRCUIT WITH INCREASED GAIN

This application is a continuation of application Ser. No. 08/349,234, filed Dec. 5, 1994 now abandoned.

CROSS REFERENCE TO RELATED APPLICATIONS

This application is related to the co-pending U.S. patent applications entitled "Amplifier Circuit and Method", filed Dec. 1, 1994, U.S. patent application Ser. No. 08/349,095, TI Docket No. TI-20009 and assigned to Texas Instruments Incorporated, herein incorporated by reference, and "Amplifier Circuit and Method", filed Dec. 1, 1994, U.S. patent application Ser. No. 08/348,662, TI Docket No. TI-20010, and assigned to Texas Instruments Incorporated, herein incorporated by reference.

FIELD OF THE INVENTION

This invention relates generally to the field of integrated circuits and the fabrication of amplifiers on integrated circuits, and specifically to the use of current output circuits such as current mirrors in the output stage circuitry of amplifiers on an integrated circuit.

BACKGROUND OF THE INVENTION

In designing and producing linear integrated circuits, and in particular amplifiers on integrated circuits, current output circuitry, usually current mirrors, are typically used as an output stage. A typical prior art current mirror is shown in FIG. 1. In FIG. 1, transistors MP05 and MP06 comprise the current mirror. The source and gate terminals are coupled together, and the source terminals are each coupled to the positive supply voltage Vs. The drain of transistor MP05 is coupled to an NMOS transistor MN05, which receives an input IN at its gate. The drain of transistor MP06 is coupled to an output terminal OUT.

In operation, the current flowing to the output OUT is equal to, approximately, the current flowing through transistor MP05 because the transistors MP05 and MP06 have the same gate to source voltage Vgs, and therefore the currents Ids will be roughly equal, or if the two transistors are of different sizes, proportional. The current flowing through transistor MP05 is equal to the current flowing through NMOS transistor MN05, which will be governed by the voltage input to the gate of transistor MN05, at the node N6 terminal, since the current Ids for MN05 will be proportional to the gate to source voltage Vgs. Assuming transistors MP05 and MP06 have equal width to length ratios, it can be seen that the two currents Ids5 and Ids6 will be approximately equal.

In designing amplifier circuits to drive a load, it is desirable that the current mirror be arranged to provide current gain. That is, it is desirable that the current at the output OUT in FIG. 1 be increased over the current flowing through transistors MN05 and MP05. This can be achieved by increasing mirror ratio, that is by making transistor MP06 larger than transistor MP05. However, this approach has some undesirable effects on the supply current and power consumption of the device, and also on the bandwidth of the resulting circuit.

FIG. 2 depicts an equivalent circuit model for performing frequency response analysis on the mirror of FIG. 1. Node N9 from FIG. 1 appears at the top of FIG. 2. The transistors MN05 and MP06 have been replaced with their equivalent circuit models, with C5 and C6 being the gate capacitances for transistors MP05 and MP06, and Gmn05 and Gmp05 being the transconductances for transistors MN05 and MP05, respectively. Using FIG. 2, the sum of the currents at node N9 can be easily extracted as:

$$-Gmn05*Vin-V[N9]\cdot(Gmp05+s\cdot(C5+C6))=0 \quad (1)$$

Solving for a voltage transfer function of V[N9]NIn, the transfer function is:

$$\frac{V[N9]}{V[N6]}=\frac{-\left(\frac{Gmn05}{Gmp05}\right)}{1+\frac{s*(C5+C6)}{Gmp05}} \quad (2)$$

Thus the DC voltage gain of the prior art current mirror of FIG. 1 is simply –Gmn05/Gmp05. More importantly, the transfer function shows a pole located at Gmp05/(C5+C6). FIG. 3 is a Bode plot of the frequency response expected from the transfer function of Equation 2. The single pole results in a –20 dB/decade rolloff starting at the pole frequency.

In circuits such as the prior art current mirror of FIG. 1, the amount of current available to a load at the output terminal is governed by two factors: the ability of the supply sources to supply current, and the ratio of transistors MP05 and MP06. The output current can be increased by increasing the supply current, and by increasing the mirror ratio; that is by increasing the size of transistor MP06 as related to transistor MP05.

Although increasing the mirror ratio will in fact increase the output current, in designing state of the art amplifiers and current mirrors for use in the output stages, increased frequency bandwidth is required. Increasing the mirror ratio actually decreases the frequency response of the circuit of FIG. 1. This can be shown as follows. The transconductance Gmp05 of transistor MP05 is proportional to the quantity:

$$\sqrt{\frac{W_{MP05}}{L_{MP05}}*I_{DS_{MP05}}}\ . \quad (3)$$

Further, the gate capacitances C5 and C6 for transistors MP05 and MP06 are proportional to W×L for transistors MP05 and MP06, respectively.

In a typical application, transistor MP06 is larger than transistor MP05 to begin with, so C6 is greater than C5. If the mirror ratio is to be increased, the width (assuming lengths to be fixed) of transistor MP06 can be increased, and/or the width of transistor MP05 can be decreased. If the width of transistor MP06 is increased, the capacitance C6 will increase. Alternatively, if the width of transistor 6 is held constant, the width of transistor MP05 could be decreased, which will decrease both the transconductance Gmp05, and the capacitance C5. The transfer function of Equation 2 shows that if either action is taken, the pole at Gmp05/(C5+C6) will be reduced, which causes the roll off in the frequency response to start earlier, as shown in FIG. 3. This expresses a decreased bandwidth in the frequency response of the circuit.

Increasing the supply current is an alternative approach to increase the output current of the current mirror of FIG. 1 without decreasing the circuit bandwidth. However, most amplifier designs call for reduced power with increased bandwidth, so a simple minded increased supply current solution is not viable, as it violates a design requirement. Thus, for an amplifier or current mirror design which requires increased output current with reduced supply current and enhanced bandwidth, the current mirrors of the prior art are inadequate solutions. Thus there is a need for an improved current mirror with increased output current and an enhanced frequency response while using a steady or reduced supply current.

SUMMARY OF THE INVENTION

A current mirror circuit is modified for increased gain. An impedance element is added to the current mirror so that the gate of the output transistor receives an additional voltage proportional to the impedance element, that is the gain of the circuit is increased by the value of the impedance element. The additional element also produces an additional pole-zero pair in the frequency response of the circuit.

Since the pole-zero pair added by the additional impedance produces an undesired gain peaking effect, especially for higher frequency circuits, the circuit is then compensated with a frequency compensation circuit. By careful selection of the values of the various elements, the circuit may be frequency compensated to get a desirable frequency response. An output amplifier using the current output circuitry of the invention is described as an example application of the invention.

BRIEF DESCRIPTION OF THE DRAWINGS

Corresponding reference numerals are used for corresponding elements throughout the figures, unless otherwise indicated in the text.

DETAILED DESCRIPTION OF PREFERRED EMBODIMENTS

Figure 4:
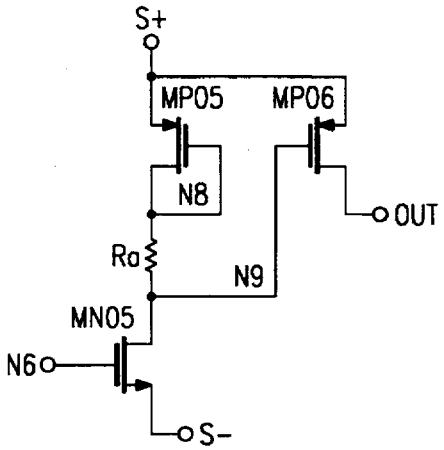
FIG. 4 depicts the circuit schematic of an improved current mirror having increased output current.

FIG. 4 depicts a schematic of an improved current mirror. In FIG. 4, elements PMOS transistor MP05, PMOS transistor MP06, NMOS transistor MN05, the input node N6, the output OUT, and node N9 are as repeated as in the prior art circuit of FIG. 1. In addition, resistor Ra is coupled between the gate to drain connection of transistor MP05 and the gate connection of transistor MP06.

Figure 1:
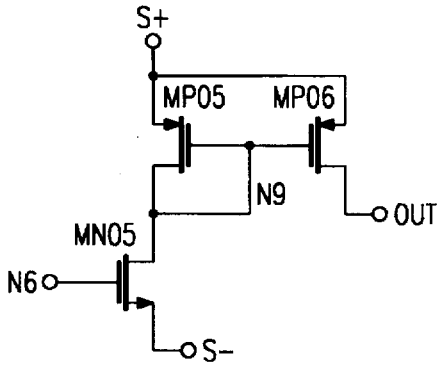
FIG. 1 (PRIOR ART)
FIG. 1 (prior art) depicts a current mirror.
Figure 2:
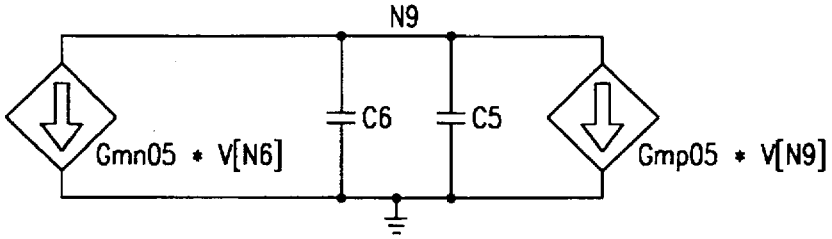
FIG. 2 (PRIOR ART)
FIG. 2 (prior art) depicts a frequency response model of the prior art current mirror of FIG. 1.
Figure 3:
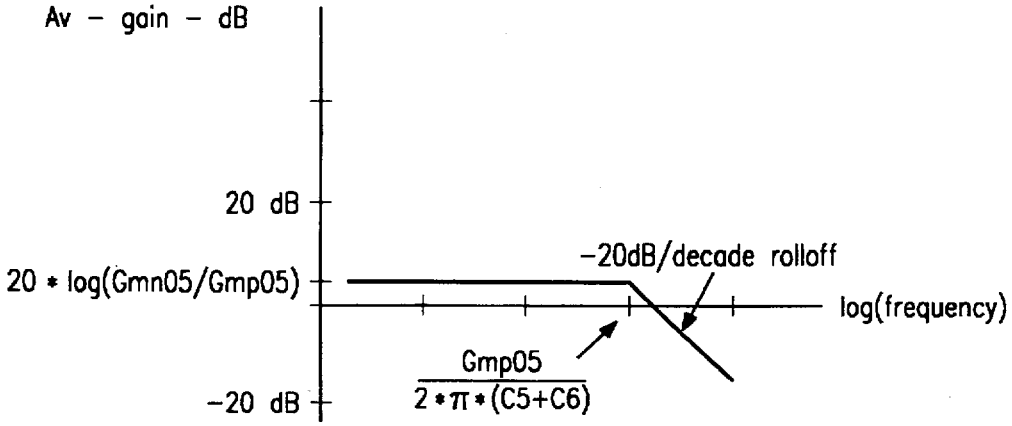
FIG. 3 (PRIOR ART)
FIG. 3 (prior art) depicts a Bode plot for the current mirror of FIG. 1.

In operation, the circuit of FIG. 4 operates as the circuit in FIG. 1, except that now the circuit of FIG. 4 has an increased output current. This can be seen easily by noting that the voltage at the gate of transistor MP06 is now increased by Ra*Ids5, over the circuit of FIG. 2. That is:

$$V_{GS6}=V_{GS5}+I_{DS5}*R_a \tag{4}$$

Figure 5:
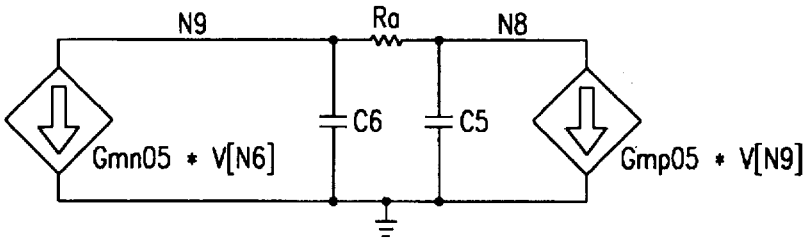
FIG. 5 depicts an equivalent circuit model for the current mirror of FIG. 4.

Although the circuit of FIG. 4 will have an improved output current, the frequency response has also been altered. FIG. 5 depicts the equivalent circuit of FIG. 4 for AC analysis. Again, the quantities are as before in FIG. 2, with the addition of Ra. Also, an additional node is needed since the gate terminals of the transistors MP05 and MP06 are no longer at a common node, this is labeled N8. Circuit analysis, consisting of summing the currents and then reducing the result to a transfer function, as before, yields a transfer function:

$$\frac{V[N9]}{V[N6]} = -(Gmn05/Gmp05)*(Gmp05*R_a+1)*\frac{(1+s/z_1)}{(1+s/p_1)*(1+s/p_2)} \tag{5}$$

Thus the voltage gain previously obtained is increased by the factor (Gmp05*Ra+1). The zero $z_1$ and the poles $P_1$ and $P_2$ are expressed in terms of Gmp05, Ra, C5 and C6 as follows:

$$z_1=\frac{(Gmp05*Ra+1)}{Ra*C5} \tag{6}$$

$$p_1=\frac{Gmp05}{C5+C6*(Gmp05*Ra+1)} \tag{7}$$

and $$p_2=\frac{(C5+C6*(Gmp05*Ra+1))}{Ra*C5*C6}. \tag{8}$$

Figure 6:
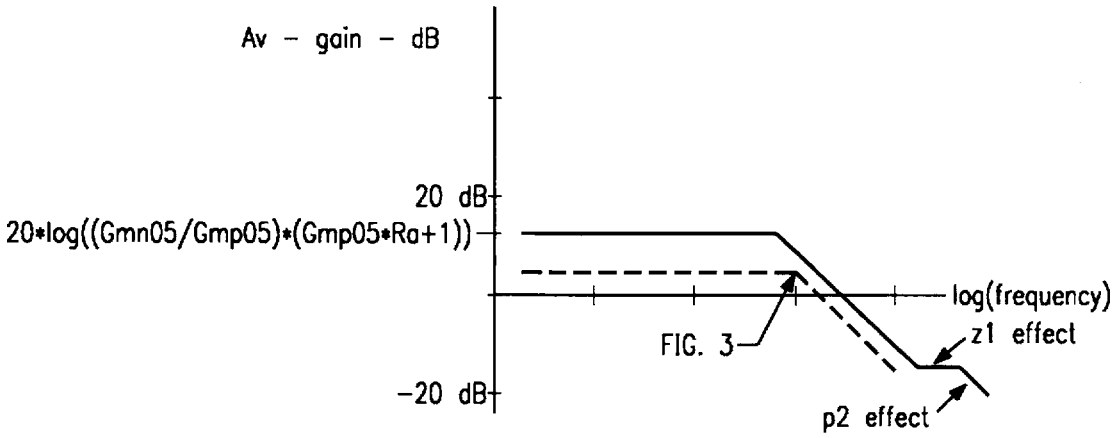
FIG. 6 depicts a Bode plot for the current mirror of FIG. 4.

The Bode plot depicting the frequency response for the circuit of FIG. 4 is shown in FIG. 6. From the plot and the equations above, several things can be observed. First, the presence of Ra in the denominator of pole p1 means that as Ra increases, the initial roll off of the circuit will begin at lower frequencies. To increase the gain of the circuit, Ra will be increased, so in application this is likely to occur. Second, note that the zero $z_1$ acts to extend the overall bandwidth of the circuit. Because the gain of the circuit is higher, this can result in so called "gain peaking". This is an undesirable effect, and if the gain of the circuit is high enough could lead to an instability in the circuit. Although the second pole $p_2$ acts to counteract the zero, the relationships are such that the dominant pole $p_1$ will be less than the zero, and less than $p_2$. As resistor Ra increases to achieve increased gain, this effect will worsen. So the addition of the resistor has increased the current output over the prior art current mirror, but has produced a circuit with an undesirable frequency response as a consequence, and also undesirable gain peaking.

Figure 7:
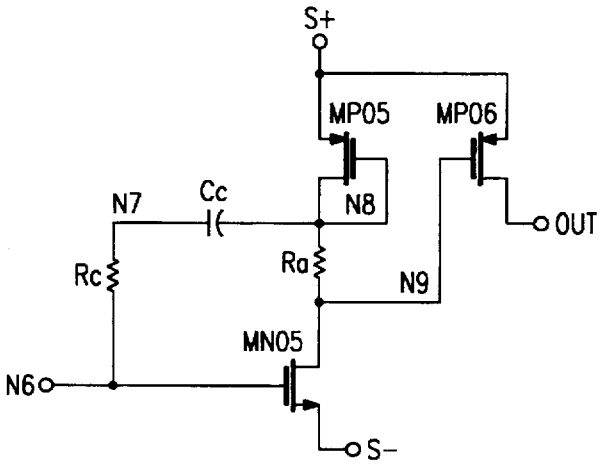
FIG. 7 depicts an improved current mirror having frequency compensation.

FIG. 7 depicts a second preferred embodiment of a current mirror which has the increased current output desired, and includes frequency compensation circuitry to eliminate the problems associated with the circuit of FIG. 4. In FIG. 7, transistors MP05 and MP06 again comprise the current mirror, as before. Transistor MN05 again receives the input N6 and controls the current through transistor MP05. Resistor Ra is the gain resistor added in FIG. 4. Additionally, compensation capacitor Cc and compensation resistor Rc are added. These elements are coupled between the gate-drain connection of transistor MP05, node N8, and the input node N6.

Figure 8:
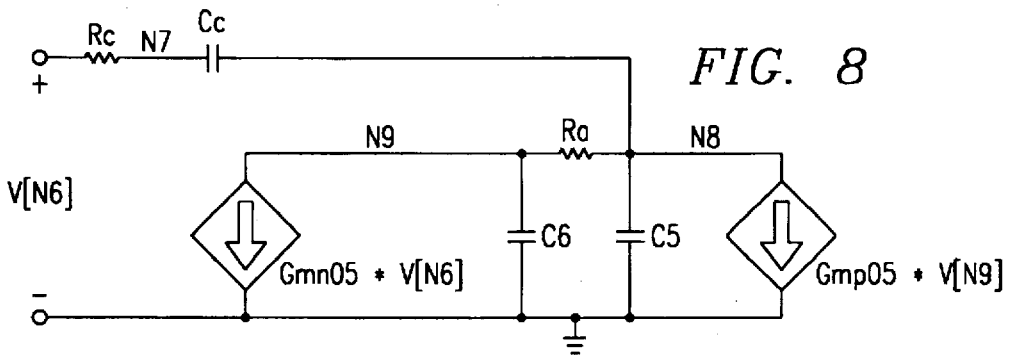
FIG.8 depicts an equivalent circuit model for the current mirror of FIG. 7.

In order to understand the operation of the circuit of FIG. 7, reference is made to the equivalent circuit diagram of FIG. 8. The transconductances for transistors MN05 and MP05 are labeled as before, as are the gate capacitances C5 and C6 for transistors MP05 and MP06.

Again, summing the currents in the equivalent model for node N9 yields:

$$-Gmn05 * V[N6] - V[N9] * \left(\frac{1}{Ra} + s * C6\right) + \frac{V[N8]}{Ra} = 0 \quad (9)$$

Similar expressions can be obtained at node N8, and V[N8] can be substituted into (9). Finally, a transfer function can be obtained for the equivalent circuit, expressed as:

$$\frac{V[N9]}{V[N6]} = -Av * \frac{1 + s * A1 + s^2 * A2}{(1 + s * B1 + s^2 * B2 + s^3 * B3)} \quad (10)$$

Equation (10) is expressed in terms of the following quantities:

$$Av = (Gmn05/Gmp05) * (Gmp05 * Ra + 1) \quad (11)$$

$$A1 = Rc * Cc + \frac{(Ra - 1/Gmn05) * Cc + Ra * C5}{Gmp05 * Ra + 1} \quad (12)$$

$$A2 = \frac{Ra * Rc * C5 * Cc}{(Gmp05 * Ra + 1)} \quad (13)$$

$$B1 = Cc * (Rc + 1/Gmp05) \quad (14)$$

$$B2 = \frac{Rc * Cc * ((Gmp05 * Ra + 1) * C6 + C5) + Ra * C6 * (C5 + Cc)}{Gmp05} \quad (15)$$

$$B3 = Ra * Rc * Cc * C5 * C6/Gmp05 \quad (16)$$

It can be seen that the transfer function above has two zeroes and three poles. Also, as expected, the gain Av is equal to the gain of the circuit of FIG. 4, and the addition of compensation circuitry Rc and Cc has not altered the gain.

If the circuit of FIG. 7 is to perform as desired, it should have the dominant pole near the location of the pole of the original circuit of FIG. 1, and have the remaining zeroes and poles arranged so the overall frequency response closely tracks that of the circuit of FIG. 1. This requires that $P1<Z1 \leqq P2<Z2 \leqq P3$.

The transfer function given in (10) can be manipulated into a pole zero form, expressed as a numerator over a denominator, and the relationships between the poles and zeros can be calculated. After some trial and error in placing values on the poles and zeroes, it will be seen that some simplifying assumptions can also be made for Cc, C6, C5, and Ra. Assuming Cc>>C6, and C6>>C5, and Ra>1/Gmn05, it can then be shown through straightforward mathematical analysis that the desired inequality $P1<Z1<P2<Z2<P3$ will be met so long as the relationship between Ra and Rc meets the following inequalities:

$$(Rc/Ra) * (Gmp05 * Ra + 1) * Cc > C5 \quad (17)$$

and $$Cc * \frac{(Gmp05 * Rc + 1) * Rc}{Rc * (Gmp05 * Ra + 1) + Ra} > C6 \quad (18)$$

and $$C6 * \frac{(Gmp05 * Ra + 1)^2 * Rc}{(Gmp05 * Rc + 1) * Ra} > C5 \quad (19)$$

If the values placed on resistors Ra and Rc make these inequalities true, then the desired frequency relationships between the poles and zeros will be obtained. Thus a value for Ra may be chosen based on the desired gain for the circuit. The values for Cc, C5, C6 and Rc are then chosen to satisfy the inequalities. For simplicity, it is recommended that the values on Cc, C5 and C6 be restricted as Cc>>C6>>C5 as above, and that the value on Ra be greater than 1/Gmn05.

Figure 9:
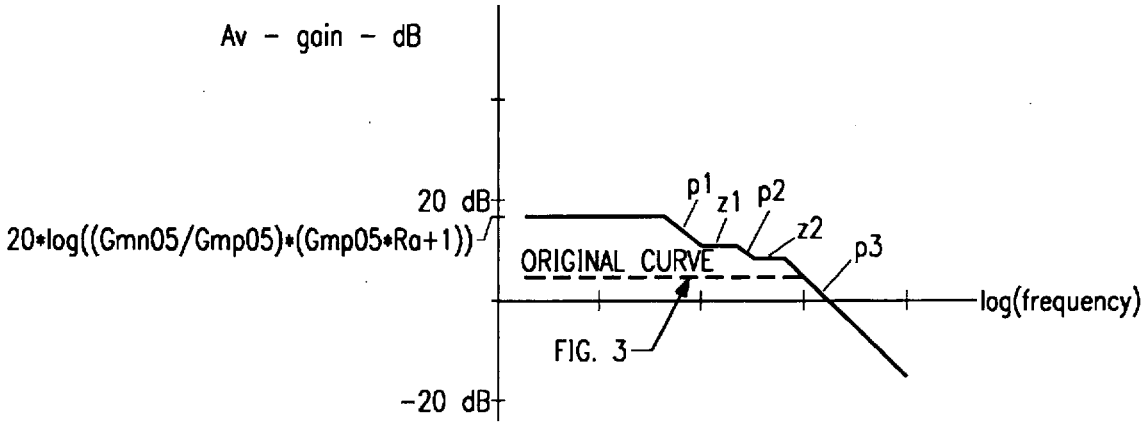
FIG. 9 depicts a Bode plot for the current mirror of FIG. 7.

The ideal frequency response for the circuit of FIG. 7 when these requirements are met is shown in FIG. 9. Now the initial gain is higher than the prior art circuit, but the poles and zeros are spaced such that the overall frequency response is very similar to the prior art current mirror, as desired. The gain peaking problem is eliminated.

The above description describes a modified current mirror implemented using MOS technology transistors. However, it is well known in the art to substitute bipolar and BiCMOS devices; and the same results can be obtained if that is done. Additionally, the embodiments above depict the improved current mirror implemented using PMOS type transistors. The same improvements shown above with a PMOS current mirror can be done with an NMOS current mirror using NMOS type transistors to achieve the same result. Also, the resistors and capacitors could be replaced with other circuit elements that result in an equivalent transfer function. The claims herein and this description anticipate and include any modifications to the circuit which are well known to those skilled in the art and result in similarly functioning circuitry.

Figure 10:
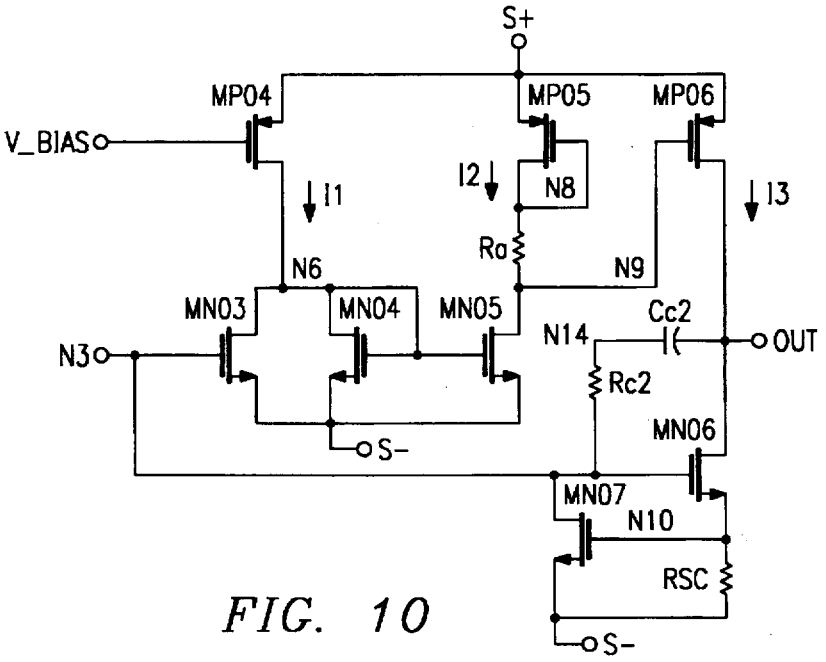
FIG. 10 depicts an output amplifier incorporating the current mirror of FIG. 7.

It has been shown above that the circuitry of FIG. 7 provides a current mirror with increased gain that has been frequency compensated to provide a response dose to the ideal. Another requirement is to increase the output current without substantial increases in the required supply current. FIG. 10 depicts a typical output stage incorporating the invention. The transistors of interest are MP04, MN03, MN04, MP05, MP06, and MN06. The current mirror of FIG. 7 is again made up from transistors MP06 and MP05, with MN05 coupled to MP05, and MP06 coupled to an output node, and resister Ra is shown which increases the gate voltage to transistor MP06, and hence the output current. MN06 and MN03 form a current mirror, as do MN04 and MN05, while MP04 acts as a current source for the circuit. Compensation circuitry Rc and Cc do not affect the supply current and are therefore not shown.

In operation, the current I1 from the drain of transistor MP04 supplies the current divider made up of transistors MN03 and MN04. The current flowing from MP06 and into MN06 is mirrored by MN03. The current flowing from MP05 and into MN05 is mirrored by MN04.

The circuitry of FIG. 10 has a self compensating feature which results in little additional supply current being consumed by the addition of resistor Ra. The total supply current of interest is equal to the sum I1+I2+I3, where I1 is the current flowing from MP04, I2 is the current flowing from the drain of transistor MP05, and I3 is the current flowing from the drain of transistor MP06, as shown in the figure. The addition of resistor Ra increases the gate voltage of MP06 by I2*Ra. The increase in gate voltage of MP06 increases I3. I3 flows into MN06 and the mirror formed with MN03, so that the current flowing into MN03 is increased, and the current flowing into MN04 is necessarily reduced in response. The current flowing into MN04 is mirrored by MN05 and reduces current I2. This results in a reduction at the gate of MP06 and thus the circuit is serf compensated. The total current consumed as supply current in the circuit with the added resistor Ra has been found in practice to be only nominally increased over the prior art amplifier without the resistance Ra.

The current mirror shown in FIG. 7 can be used in an amplifier as shown in FIG. 10 to increase the current output without gain peaking or reduced bandwidth, and without substantially increasing the power consumed by supply current.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A current mirror circuit, comprising:

a circuit output terminal for outputting a current;

a circuit input terminal for receiving an input voltage;

a first transistor having first and second electrodes and a current path between said first and second electrodes, said current path of said first transistor coupled between said circuit output terminal and a first voltage source, and said first transistor having a control electrode;

a second transistor having first and second electrodes and a current path between first and second electrodes, said current path of said second transistor coupled between said first voltage source and a reference node, and said second transistor having a control electrode coupled to said reference node;

an impedance having a first terminal coupled to said reference node and having a second terminal coupled to the control electrode of said first transistor;

a third transistor having first and second electrodes and a current path between first and second electrodes, said current path of said third transistor coupled between said second terminal of said impedance and a second voltage source, said third transistor having a control electrode coupled to said circuit input terminal, and said third transistor controlling the current flowing in said impedance responsive to a voltage input at said circuit input terminal; and frequency compensation circuitry coupled having a first terminal coupled to said reference node and a second terminal coupled to the control electrode of said third transistor.

2. The current mirror of claim 1, wherein said first transistor outputs a current at said circuit output terminal which is proportional to the value of said impedance, said frequency compensation circuitry being operable to cause the gain of said current mirror to decrease at a predetermined rate above a threshold frequency.

3. The current mirror of claim 1, wherein said impedance comprises a metallic resistor.

4. The current mirror of claim 1, wherein said impedance comprises a polysilicon resistor.

5. The current mirror of claim 1, in which said first and second transistors are PMOS transistors and said third transistor is an NMOS transistor.

6. The current mirror of claim 1, wherein said frequency compensation circuitry comprises:

an impedance coupled to said reference node, and having an output terminal; and a capacitance coupled between the output terminal of said impedance and the gate terminal of said third transistor.

7. The current mirror of claim 6, wherein said impedance within said frequency compensation circuitry comprises a polysilicon resistor.

8. The current mirror of claim 6, wherein said impedance within said frequency compensation circuitry comprises a metallic resistor.

* * * * *